US010124873B2

(12) United States Patent
Aguirre

(10) Patent No.: US 10,124,873 B2
(45) Date of Patent: Nov. 13, 2018

(54) MOTORIZED KAYAK

(71) Applicant: Timothy Paul Aguirre, Newport Beach, CA (US)

(72) Inventor: Timothy Paul Aguirre, Newport Beach, CA (US)

( * ) Notice: Subject to any disclaimer, the term of this patent is extended or adjusted under 35 U.S.C. 154(b) by 0 days.

(21) Appl. No.: 14/616,714

(22) Filed: Feb. 8, 2015

(65) Prior Publication Data

US 2016/0229510 A1 Aug. 11, 2016

(51) Int. Cl.
*B63H 21/17* (2006.01)
*B63B 35/71* (2006.01)

(52) U.S. Cl.
CPC ..... *B63H 21/17* (2013.01); *B63B 35/71* (2013.01)

(58) Field of Classification Search
CPC ..... B63H 21/17; B63B 35/71
USPC ..... 114/347, 121
See application file for complete search history.

(56) References Cited

U.S. PATENT DOCUMENTS 3,847,348 A * 11/1974 Russ ..... G06G 7/70 114/122
5,937,785 A * 8/1999 Murray, III ..... B63B 35/71 114/347
2011/0201238 A1* 8/2011 Rott ..... B63B 35/7943 440/6
2013/0059489 A1* 3/2013 Vlock ..... B63B 7/085 440/6

* cited by examiner

*Primary Examiner* — Stephen P Avila
(74) *Attorney, Agent, or Firm* — Techlaw LLP; Sam Tahmassebi

(57) ABSTRACT

Disclosed herein is a motorized kayak comprising: a hull; a hatch; a motor; a pump; a controller; and one or more batteries; wherein the hull and hatch create a water and air tight seal and the position of the batteries is adjustable to change the center of gravity.

17 Claims, 3 Drawing Sheets

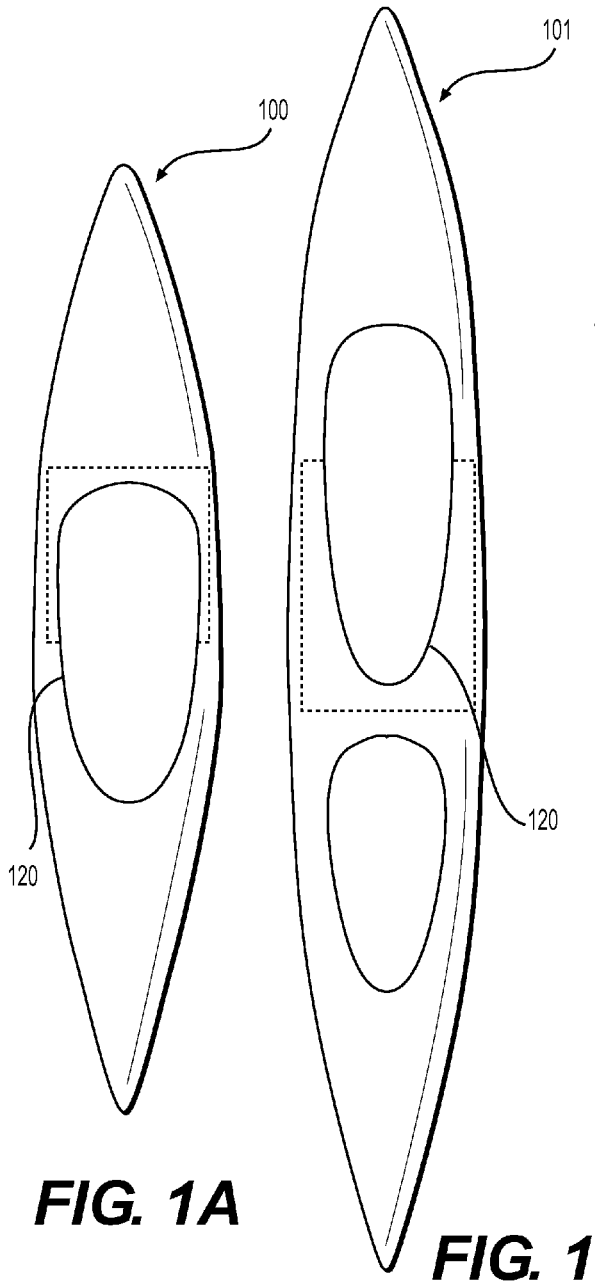
FIG. 1A
FIG. 1B
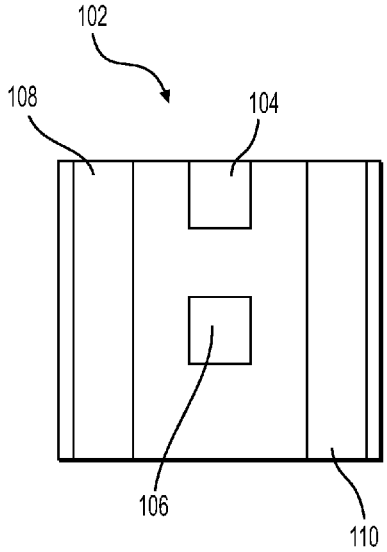
FIG. 1C

MOTORIZED KAYAK

FIELD OF THE INVENTION

The present invention is in the field of motorized kayaks.

BACKGROUND

Kayaks are small boats that are typically used in oceans, rivers, lakes, or other bodies of water. Kayaks come in various shaped hulls and can seat one or two people. Kayaks are made from various materials, including wood, plastic, and fiberglass. Traditionally, riders manually propel the kayak with a double-ended paddle. Kayaks are also propelled by foot activated pedals or by gas motors. However, kayaks with gas motors require breather holes for a carburetor, which prevent the kayak from being submerged. Thus, what is needed is a fully submersible, electrically powered kayak.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of various embodiments, a motorized kayak with the ability to be water and air tight is provided, the kayak comprising: a waterproof hull; a waterproof hatch removably connected to the waterproof hull; a power pod comprising an electric motor, a controller system, and a battery system, wherein the power pod system is disposed within the waterproof hull beneath the waterproof hatch; and a pump disposed within the waterproof hull, wherein the pump is connected to the electric motor.

In one aspect of various embodiments, a motorized kayak with the ability to be water and air tight is provided, the kayak comprising: a waterproof hull; a waterproof hatch removably connected to the waterproof hull; a power pod comprising a first electric motor, a controller system, a sensor system, and a battery system, wherein the power pod system is disposed within the waterproof hull beneath the waterproof hatch, and wherein the position of the battery system is adjustable for biasing the kayak weight; a paddle comprising a throttle in radio communication with the controller system; and a pump disposed within the waterproof hull, wherein the pump is connected to the electric motor.

In one aspect of various embodiments, a motorized kayak with the ability to be water and air tight is provided, the kayak comprising: a waterproof hull; a waterproof hatch removably connected to the waterproof hull; a power pod removably connected to the waterproof hull, the power pod comprising a first electric motor, a controller system, a sensor system, and a battery system, wherein the power pod system is disposed beneath the waterproof hatch, and wherein the position of the battery system is adjustable for biasing the kayak weight; a paddle comprising a throttle system in radio communication with the controller system, wherein the throttle system is removably connected to the paddle, and wherein the throttle system is configured to transmit data to the controller system, and the controller system is configured to receive data from the throttle system, and wherein the controller system generates an output and provides it to the battery system to alter a power delivered to the first electric motor; and a pump disposed within the waterproof hull, wherein the pump is removably connected to the first electric motor.

BRIEF DESCRIPTION OF THE DRAWINGS

FIG. 1A is a top view of an embodiment of a one-person motorized kayak.

FIG. 1B is a top view of an embodiment of a two-person motorized kayak.

FIG. 1C is a top view of an embodiment of a power pod system, which may be installed in both one-person and two-person kayaks.

DETAILED DESCRIPTION OF THE EMBODIMENTS

Figure 2:
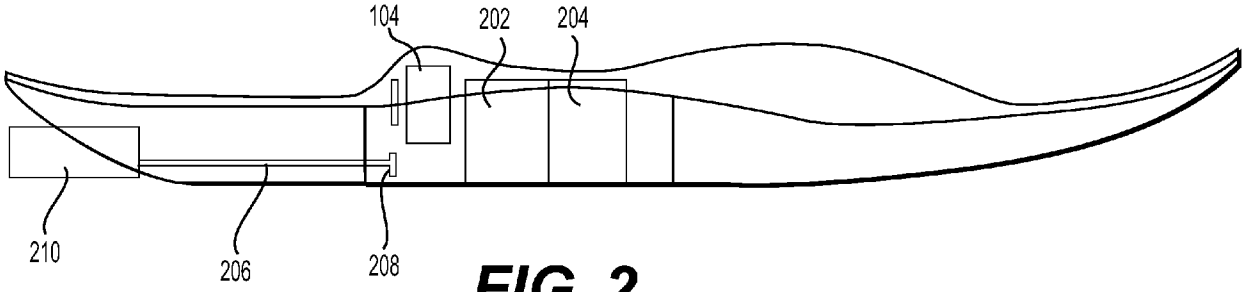
FIG. 2 is a side view of an embodiment of a one-person kayak with the power pod system installed.

In the following detailed descriptions of various exemplary embodiments, reference is made to the accompanying drawings that form a part hereof, and in which is shown, by way of illustration, specific embodiments that may be practiced. It is to be understood that other embodiments may be utilized and structural changes may be made without departing from the scope of the present disclosure.

Disclosed herein are devices for a kayak propelled by an electric motor enclosed in an adjustable power pod system that can be adjusted to change the weight distribution of the kayak. The presently disclosed electric motor is in communication with a controller that is in communication with an external throttle. The presently disclosed power pod system comprises one or more removable batteries and/or one or more removable power supplies, which can be moved forward and backward within the power pod system to adjust the center of gravity for the size of one or more riders. The hull of the kayak is waterproof and sealed from water ingression to allow for complete submersion of the kayak.

Referring to FIGS. 1A-B, disclosed herein are one-person electric powered kayak 100 and two-person electric powered kayaks 101. The kayak comprises a power pod system 102, which is situated beneath the seat position 120 of the rider or at a center of gravity position of the kayak 100,101. Referring to FIG. 1B, disclosed herein is a two-person electric powered kayak 101 with a power pod system 102, which is situated beneath the seat position 120 of the rider. Positioning the power pod system 102 beneath the rider and at a center of gravity point will allow for an ideal weight distribution regardless of rider or cargo. FIGS. 1A-B illustrates embodiments of the shape of the kayak. In some embodiments, the kayak's shape comprises ornamental designs. In other embodiments, not shown, the kayak may have a different shape suitable for watercraft.

FIG. 1C shows an embodiment of the power pod system 102. Power pod system 102 comprises an electric motor 104, a controller 106, and at least one battery cage 108. In some embodiments, there may be two battery cages 108 and 110, located on the left and right sides of the power pod system 102, thus allowing the rider to seat between the batteries thus creating a lower center of gravity. In some embodiments, one battery cage 108 holds two batteries 202,204, as shown in FIG. 2. In other embodiments there is a single battery 202.

One or more batteries 202,204 may be removable so that they can be replaced, charged, or to make the kayak 100, 101,200 lighter and easier to transport. The battery cage 108,110, may be adjustable for sliding the battery cages forward and/or rearward in the power pod system 102. In this manner, the weight distribution of the kayak 100,101 can be adjusted by sliding the one or more batteries 202,204 toward the front or rear of the kayak 100,101 for accommodating the weight of the rider and cargo. This adjustability may allow for optimal weight distribution and boat performance.

In some embodiments, the position of the battery cage 108,110 within the power pod system 102 may be adjustable using a manual adjustment means such as a lever, a handle, a wheel, a crank, a worm-gear mechanism, and so forth. In other embodiments, the battery cage 108,110 position is adjustable with an electric motor (not shown) which may be powered by the battery cages 108,110. In some embodiments, the electric motor may be turned on or off with a single-pole switch, momentary switch, kill-switch, and the like. In other embodiments, the electric motor may be controlled by the controller 106. The controller 106 may comprise at least one processor (not shown), which may be programmed to adjust the battery cage 108,110 forward or rearward by actuating the motor using an analog or digital sensor system (not shown) input. The sensor system input may measure the weight distribution of the kayak 100,101 by sensing the forward or rearward tilt of the kayak 100,101. As an example, as the kayak pitches forward, the sensor detects a weight imbalance, actuates the motor to push the battery cages 108,110 rearward. In some embodiments, the sensor system may be an inclinometer, an accelerometer, or a tilt sensor.

In still other embodiments, the battery cage 108,110 may also be adjustable to the left side or right side of the kayak 100,101. This may be advantageous for minimizing roll of the kayak 100,101.

In yet other embodiments, the power pod system 102 may be removable from the kayak 100,101.

Figure 3:
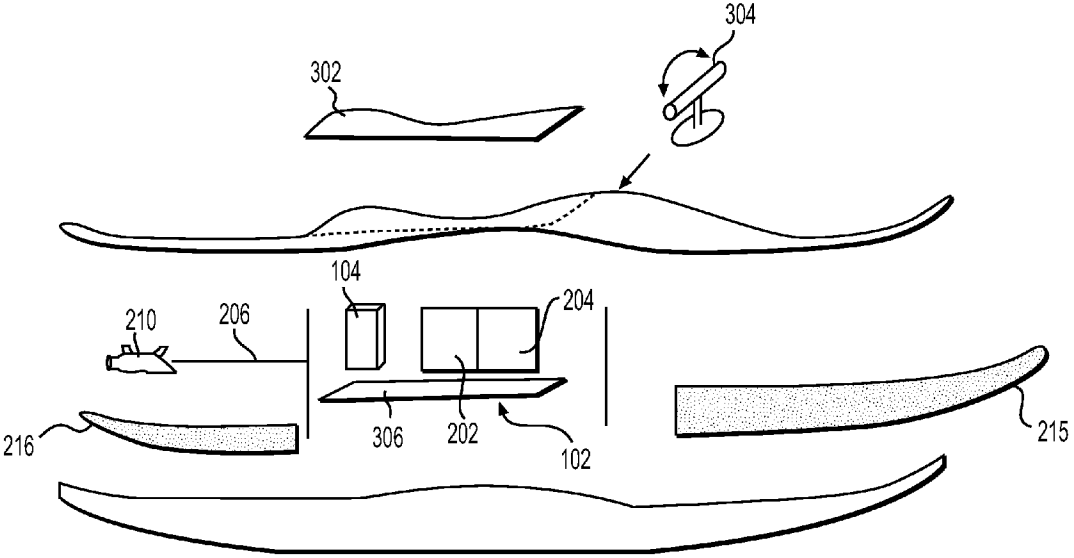
FIG. 3 is an exploded side view of FIG. 2.

In some embodiments the power pod system 102 is positioned on the bottom of the kayak 200 beneath the rider. In other embodiments, a plate 306 is between the power pod system 102 and the bottom of the kayak, as shown in FIG. 3. The plate 306 may be aluminum or other type of metal or metal composite, wood, plastic, carbon fiber, or other type of composite material. In other embodiments the power pod system 102 rests on bars or rails (not shown), which can be aluminum, metal, metal composite, wood, plastic, carbon fiber, or another type of composite material. In still other embodiments, the power pod system 102 may rest on one or more ballscrews, the rotation of which may cause the power pod system 102 to move forward or rearward. In some embodiments, the one or more battery cages 108,110 are placed flat on the surface of the plate 306. In other embodiments the one or more battery cages 108,110 are placed at an angle to the surface of the plate 306.

The power pod system 102 may be installed in one-person 100 and two-person kayaks 101. The power pod system 102 may be positioned below the rider's seat, as shown in FIG. 1 and FIG. 2. In some embodiments the electric motor 104 is connected by a drive shaft 206 and a sprocket 208 to a pump 210 in the rear of kayak 200, as shown in FIG. 2. In other embodiments the electric motor 104 is connected by a drive shaft 206 to a pump 210 without sprocket 208. In some embodiments the pump 210 is a water jet pump 210. In other embodiments the electric motor 104 may be connected to a propeller (not shown). While still in other embodiments, the electric motor 104 is connected to the drive shaft 206 via a transmission (not shown), for increasing or decreasing the drive shaft 206 rotational speed.

In some embodiments, kayak 200 has a conventional rudder (not shown) for steering. In other embodiments, the output of the jet pump output may vary position when a steering control is adjusted. In some embodiments, the steering control is a steering bar 304, as shown in FIG. 3. While in other embodiments, the steering control is a joystick (not shown). In some embodiments the steering control is located near the hands, as shown in FIG. 3. While in other embodiments the steering control is located near the feet. The handle may be a "T" shape (as shown in FIG. 3), a wheel, a joystick, or the like. In some embodiments, the T-shaped handle may have a hinge on both sides so that the right and left side handle may bend of fold in the upward position, which may be advantageous in case the rider is ejected from the craft.

The electric motor 104 does not require breather holes so the power pod system 102 and kayak 100,101,200 can be sealed from water ingression. In some embodiments, the kayak 200 comprises a waterproof hatch 302 enclosing the power pod system 102, which allows for the kayak 200 to be water and air tight like traditional, non-motorized kayaks. In other embodiments, the motor 104 may be waterproof thereby eliminating the need for a waterproof hatch 302. In still other embodiments, the kayak may have foam inserts 215,216 for additional flotation.

Figure 4:
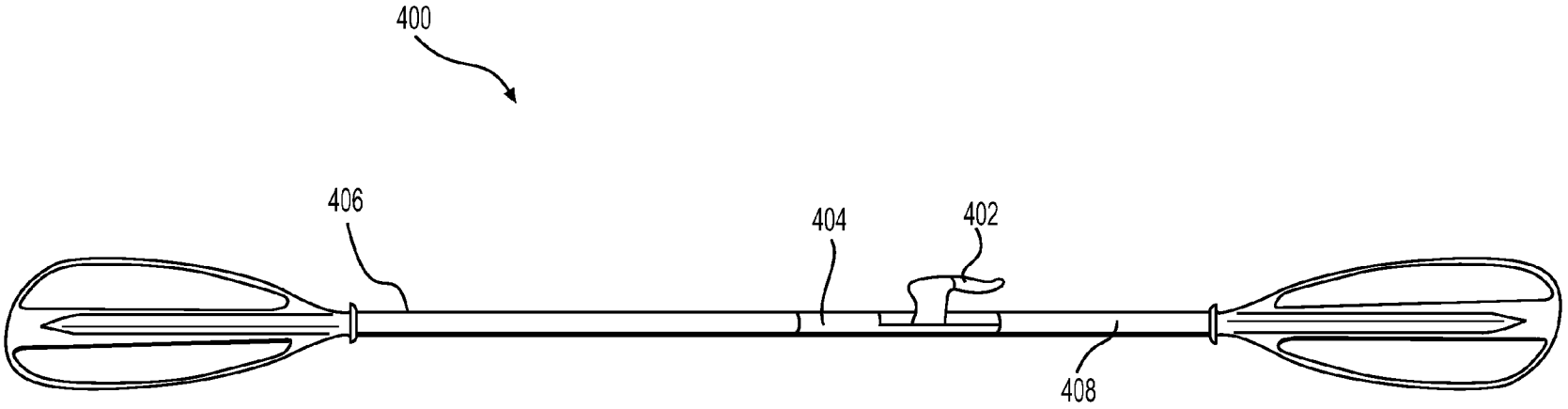
FIG. 4 is a perspective view of an embodiment of a dual blade paddle with wireless throttle components.

In some embodiments, the controller system 106 is controlled by trigger throttle 402 in throttled paddle 400, as shown in FIG. 4. By having the throttle system 402 in the paddle, it is easier for the rider to control the motor 104 when riding in the kayak 100,101,200. In some embodiments, the trigger throttle 402 is part of universal throttle body 404 that can connect to paddles of various sizes and configurations. FIG. 4 shows an embodiment of a disconnected paddle with sides 406 and 408, where paddle side 408 is connected to universal throttle body 404. The paddle 400 can be removed from one or more ends of the throttle 404 for easier storage. In other embodiments, the paddle 400 cannot be disconnected and trigger throttle 402 is integrated with the paddle 400. In some embodiments, a rechargeable battery is built into universal throttle body 404, shown in FIG. 4. In other embodiments, trigger throttle 402 is not part of the paddle, but is a stand alone throttle. In some embodiments, trigger throttle 402 is located near the rider's feet. In other embodiments trigger throttle 402 is located near the rider's hands.

In some embodiments, trigger throttle system 402 is in data communication with controller 106, which may be a computer processor that controls the function of the motor 104. In some embodiments, the communication is wired and trigger throttle 402 is attached by a data cable to controller 106. In other embodiments, the communication is wireless through radio frequencies such as Bluetooth, UHF, VHF, or other radio frequencies or standards known to those skilled in the art. In some embodiments, the wireless communication of throttle 402 operates within three feet of controller 106 which may be advantageous as a safety feature. If a rider falls out of the kayak 100,101,200, then the throttle 402 may be unable to send a signal or be detected by the controller 106 which in turn would disable power to the motor 104. In other embodiments, the throttle 402 may be disengaged if the rider is separated from the kayak by means of a kill-switch lanyard, pressure sensitive seat, proximity sensor, and so forth.

In some embodiments, the throttle system 402 may be in communication the controller system 106 for sending a signal to maintain, increase or decrease the speed of the motor 104, whereby the motor 104 may draw power from the battery system 108,110. The controller system 106 may be configured to receive an analog or digital signal from the throttle system 402 through an antenna (wireless) or through one or more wires.

In some embodiments, controller 106 is in data communication with a smart phone, tablet, or other device. The user may control the kayak's power output, top speed, and other power settings through the data communication. In some embodiments, the device may also monitor the electrical system, run diagnostics of the electrical system, record data, set personalized power settings, set personalized route settings, and so forth. In some embodiments, the data communication may be wired where the device connects to the controller by a data cable. In other embodiments the communication is through radio waves, such as Bluetooth, UHF and VHF radio.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A motorized kayak comprising:

a waterproof hull;

a waterproof hatch removably connected to the waterproof hull;

a power pod system comprising a first electric motor, a controller system, a throttle system, and a battery system, wherein the power pod system is disposed within the waterproof hull beneath the waterproof hatch, wherein the controller system further comprises a sensor system, at least one secondary electric motor connected to the battery system, and at least one processor configured to receive data from the sensor system, to calculate an optimal position for the battery system, and to operably move the power pod system using the at least one secondary electric motor; and a pump disposed within the waterproof hull, wherein the pump is connected to the first electric motor.

2. The motorized kayak of claim 1, wherein the position of the battery system is adjustable for relocating the kayak's center of gravity.

3. The motorized kayak of claim 1, wherein the throttle system is disposed within a paddle.

4. The motorized kayak of claim 1, wherein the throttle system is in radio communication with the controller system.

5. The motorized kayak of claim 1, wherein the throttle system is configured to transmit data to the controller system, and the controller system is configured to receive data from the throttle system, and wherein the controller system generates an output and provides it to the battery system to alter a power delivered to the motor.

6. The motorized kayak of claim 1, wherein the sensor system provides data related to the kayak's angle of orientation.

7. The motorized kayak of claim 1, wherein the sensor system comprises at least one accelerometer.

8. The motorized kayak of claim 1, wherein the sensor system comprises an inclinometer.

9. The motorized kayak of claim 1, wherein the pump is a water jet pump for propelling the kayak.

10. A motorized kayak comprising:

a waterproof hull;

a waterproof hatch removably connected to the waterproof hull;

a power pod system comprising a first electric motor, a controller system, a sensor system, and a battery system, wherein the power pod system is disposed within the waterproof hull beneath the waterproof hatch, and wherein the controller system is operably connected to the sensor system, at least one secondary electric motor connected to the battery system, and at least one processor configured to receive data from the sensor system, to calculate an optimal position for the battery system, and to operably move the power pod system by generating an output and providing it to the battery system to alter a power delivered to the second electric motor, and wherein the position of the battery system is adjustable for relocating the kayak's center of gravity;

a paddle comprising a throttle system in radio communication with the controller system; and a pump disposed within the waterproof hull, wherein the pump is connected to the first electric motor.

11. The motorized kayak of claim 10, wherein the throttle system is configured to transmit data to the controller system, and the controller system is configured to receive data from the throttle system, and wherein the controller system generates an output and provides it to the battery system to alter a power delivered to the first electric motor.

12. The motorized kayak of claim 10, wherein the sensor system provides data related to angle of orientation.

13. The motorized kayak of claim 10, wherein the sensor system comprises at least one accelerometer.

14. The motorized kayak of claim 10, wherein the sensor system comprises an inclinometer.

15. The motorized kayak of claim 10, wherein the pump is a water jet pump for propelling the kayak.

16. A motorized kayak comprising:

a waterproof hull;

a waterproof hatch removably connected to the waterproof hull;

a power pod system removably connected to the waterproof hull, the power pod system comprising a first electric motor, a controller system, a sensor system, and a battery system, wherein the power pod system is disposed beneath the waterproof hatch, and wherein the position of the battery system is adjustable for relocating the kayak's center of gravity;

a paddle comprising a throttle system in radio communication with the controller system, wherein the throttle system is removably connected to the paddle, and wherein the throttle system is configured to transmit data to the controller system, and the controller system is configured to receive data from the throttle system, and wherein the controller system generates an output and provides it to the battery system to alter a power delivered to the first electric motor; and a pump disposed within the waterproof hull, wherein the pump is removably connected to the first electric motor.

17. The motorized kayak of claim 16, wherein the controller system comprises at least one processor configured to receive data from the sensor system and calculate an optimal position for the battery system, and wherein the position of the battery system is adjustable by a second electric motor.

* * * * *